United States Patent [19]

Skoli et al.

[11] 3,945,411

[45] Mar. 23, 1976

[54] SYSTEM FOR MIXING VARIOUS KINDS OF FLUIDS FOR PRODUCING BEVERAGES, AND MEANS FOR CLEANING THE APPARATUS BETWEEN OPERATIONS

[75] Inventors: Sigmund P. Skoli, Elmwood; Chester J. Witt, Chicago; Hartl R. Jones, Bensenville, all of Ill.

[73] Assignee: Mojonnier Bros. Co., Chicago, Ill.

[22] Filed: Apr. 1, 1974

[21] Appl. No.: 456,760

[52] U.S. Cl. ..... 141/91; 134/169 R; 134/169 C

[51] Int. Cl.[2] ..... B65B 3/04

[58] Field of Search.. 134/22 R, 229, 166 R, 166 C, 134/169 R, 169 C, 171; 141/82, 85, 89–91; 222/148

[56] References Cited

UNITED STATES PATENTS

| | | | |
|---|---|---|---|
| 3,036,741 | 5/1962 | Hilts | 222/148 |
| 3,430,639 | 3/1969 | Roberts | 141/91 X |
| 3,733,840 | 5/1973 | Pearl et al. | 222/148 X |

FOREIGN PATENTS OR APPLICATIONS

| | | | |
|---|---|---|---|
| 1,389,884 | 3/1964 | France | 141/89 |

*Primary Examiner*—Richard E. Aegerter
*Assistant Examiner*—Frederick R. Schmidt
*Attorney, Agent, or Firm*—Olson, Trexler, Wolters, Bushnell & Fosse, Ltd.

[57] ABSTRACT

The embodiment of the invention disclosed herein is directed to apparatus for mixing various kinds and quantities of fluids to prdduce an admixture of beverages which is to be delivered to a filling station wherein the beverage is used to fill a plurality of receptacles, such as bottles and cans. The various stations of the apparatus include flow control valve means which allow the appropriate flow of fluid for producing the admixture of beverage during one instance and which closes off the flow of such fluids of the syrup and admixture for allowing the flow of a cleaning flud through the apparatus during another instance, this flow of cleaning fluid taking place without the need of disconnection of various fluid flow conduits or the like. Heating means, integrated in the system, elevates the temperature of the cleaning fluid sufficient to provide a sterilizing effect within the system. Also associated with one of the container devices of the system is a supply tank of chemical cleaning material to be added to the cleaning fluid during the in-place cleaning operation.

5 Claims, 11 Drawing Figures

SYSTEM FOR MIXING VARIOUS KINDS OF FLUIDS FOR PRODUCING BEVERAGES, AND MEANS FOR CLEANING THE APPARATUS BETWEEN OPERATIONS

BACKGROUND OF THE INVENTION

This invention relates generally to apparatus for controlling mixing of various kinds and quantities of fluid, and more particularly to apparatus for controlling the flow of fluids to produce an admixture of a beverage containing $CO_2$ therein.

Apparatus for controlling the fluid flow of water and syrup to provide an admixture of a flavored beverage is well-known in the art. Such apparatus is set up to provide a production run for a number of bottles or cans of such beverage which is sufficient to warrant the cost of set up and cleaning the apparatus. The overall cost of the finished bottled or canned beverage must include the cost of dismantling the mixing and bottling apparatus and cleaning the same. Therefore, it is advantageous to provide improved apparatus which substantially reduces the time and cost for cleaning the apparatus between various production runs of different flavored beverages and the like.

Also, during limited production runs of several flavored beverages it is necessary to stop production and clean the apparatus to before changing to the flavor of the beverage to be produced during a subsequent production run. This also causes the overall cost of the canned or bottled beverage to increase if the clean-up operation is not accomplished in a short period of time.

SUMMARY OF THE INVENTION

Accordingly, it is an object of this invention to provide a new and improved beverage-forming apparatus of the type which enables rapid clean-up between production runs while at the same time maintaining a high degree of cleanliness between production runs of particular beverages.

Another object of this invention is to provide an apparatus for mixing various kinds and quantities of fluids to produce an admixture of various beverages which is capable of being cleaned in place without the necessity of dismantling various containers through which the various fluids are processed.

Many other objects, features and advantages of this invention will be more fully realized and understood from the following detailed description when taken in conjunction with the accompanying drawings wherein like reference numerals throughout the various views of the drawings are intended to designate similar elements or components.

DETAILED DESCRIPTION OF THE ILLUSTRATED EMBODIMENTS

Figure 1:
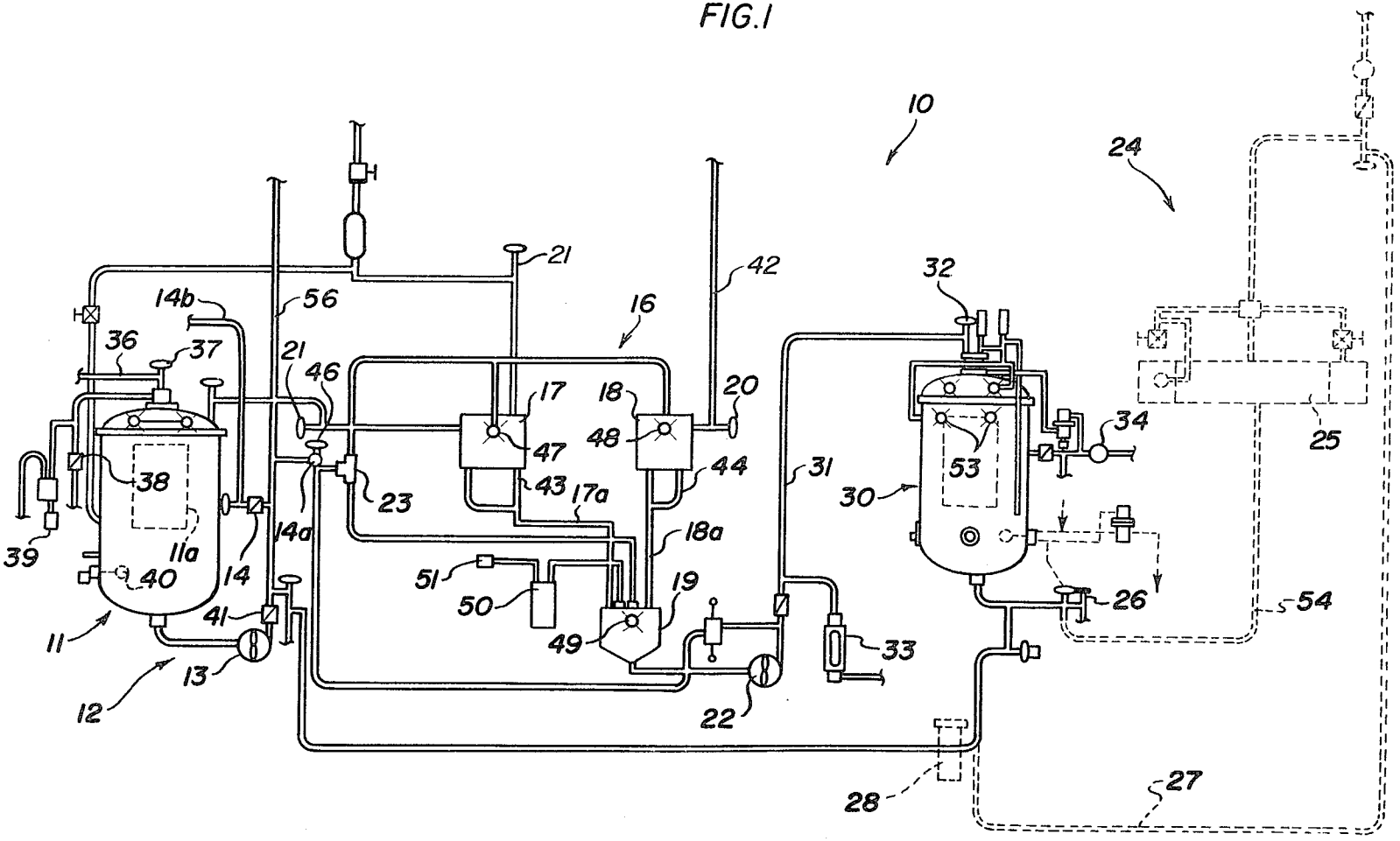
FIG. 1 is a schematic representation of apparatus for mixing various kinds of fluids for producing beverages and includes means for cleaning the apparatus in place between operations.

Referring now to FIG. 1 there is seen one form of apparatus for mixing various kinds and quantities of fluid to produce an admixture of various carbonated beverages which is designated generally by reference numeral 10. The apparatus 10 includes first container means 11 which receives a quantity of water which is degassified in a well-known manner. The container means 11 is what is commonly referred to in the art as a "Vac-U-Cooler" or deaerator.

The deaerator 11 receives the water to be used and agitates this water to release trapped gases. A gas removal system (not shown) is operatively connected with the interior of the vessel 11 to withdraw the gases released upon agitation. To further enhance deaeration, the water is cooled by flowing over cooling plates 11*a*, the ability of a liquid to release previously absorbed gases varying inversely with the temperature thereof. The container means 11 includes first flow control means 12 having a flow control pump 13 to control the flow of fluid for mixing with the beverage during one instance, and flow control valves 14 and 14*a* for controlling the application of cleaning fluid into the system during another instance. Associated with the flow control valve 14 is a hot water make-up line 14*b* which will supply additional quantities of hot water when needed.

During the operation of forming a flavored carbonated beverage, the degassified fluid from the container means 11 is supplied to a second container means 16 (schematically shown) which comprises a water receiving flow control chamber 17 and a syrup receiving flow control chamber 18. The water and syrup are delivered through gravity feed lines 17*a* and 18*a*, respectively, to a mixing flow control chamber 19 wherein the proper quantities of water and flavored syrup are combined. The second container means 16 includes flow control valve means formed by a pair of control valves 20 and 21 which control the application of syrup and water, respectively, and by a pump 22 at the output of the mixing chamber 19. The second flow control valve means also includes a control valve 23 which supplies to the water and syrup chambers a quantity of cleaning fluid during a cleaning cycle. The receiving chambers 17 and 18 and mixing chamber 19, together with the associated fluid lines constitute what is termed in the art as a proportioner. These proportioners can control the ratio of syrup-to-water in the liquid product in mixing chamber 19. A preferred type of proportioner is shown in U.S. Pat. No. 3,237,808.

The combined degassified water and syrup which forms the flavored beverage is ultimately delivered to (schematically shown) filler means 24 which has associated therewith a filler chamber 25 which receives the beverage and automatically fills and seals containers such as bottles or cans. The flavored beverage is delivered to the filler means 24 through a third flow control valve means 26 during the filling operation. A cleaning fluid is delivered to the filler means 24 during a cleaning operation, which cleaning fluid is recycled through a recycle line 27, an electric heater means 28, and thence back to the output line associated with flow control valve 14. This output line then recycles the fluid from the filler means 24 back into the water and syrup chamber 17 and 18 and into the mixing chamber 19. Therefore, a substantial economy of operation is obtained by providing the recycle operation, as well as providing heater means in the line to raise the temperature of the fluid to a sterilizing temperature.

When the flavored beverage is to be carbonated, as is the usual case, a carbonating station is interposed between the output of the mixing chamber 19 and the input of the filler means 24. For this purpose carbonating apparatus in the form of a closed vessel called a carbo-cooler 30 is provided to receive the output of the pump 22 through a line 31 and a valve mechanism 32. The carbo-cooler 30 is of the conventional carbonator-cooler type. Briefly, fluid product introduced into the unit and flows over cooled, baffled plates while being subjected to a carbon dioxide atmosphere. This type of carbonating apparatus is well known and produces a highly stable carbonated product, with a generally uniform degree of carbonation. To provide a high degree of control and uniformity in the carbonation process, a pre-carbonating control mechanism 33 is interposed into line 31 to initially introduce quantities of $CO_2$ into the liquid product prior to delivery to vessel 30. The utilization of the pre-carbonating device 33 provides means for rapidly controlling the percent of carbonation added to the flavored beverage. Carbon dioxide gas is also supplied to the carbo-cooler 30 through a supply line and regulator 34 which provides the major quantity of carbonation to the beverage. It will be understood that the percent of carbonation is also controlled through the regulator 34 if desired. This pre-carbonating system is generally that shown described in U.S. Pat. No. 3,741,552.

During operation of manufacture of a flavored beverage, a supply of water is delivered to the deaerator 11 through a line 36 and the rate of flow into the vac-U-cooler is controlled by a filler inlet valve 37. A safety relief valve 38 and a moisture trap device 39 are also associated with the vac-U-cooler as is a float control mechanism 40. Water passes through the vac-U-cooler and is subjected to a vacuum to degassify the water of undesired intrapped oxygen and the like. The degassified water is delivered via the pump 13 through a check valve 41 into the flow control tank 17. The rate of flow of water into the flow control tank is controlled by the flow-mix water control valve 21. A quantity of flavored syrup is delivered to the flow control chamber 18 through a line 42 and this flow is controlled by valve 20. The water and syrup from flow control chambers 17 and 18 are delivered to the mixing chamber 19.

Water and syrup are supplied to the separate but juxtaposed fluid tanks and the level of fluid therein is maintained at a predetermined level. The means to maintain the fluid within the tanks at such predetermined level may be any conventional level control device such as a float within the tank or electrical probes within the tank responsive to the level of fluid therein to supply water and syrup to the tank as needed. The water and syrup in the tanks are continuously recycled therein by pumping the liquid downwardly from the tank to a pump which has an impeller located below the discharge opening at the bottom of the tank. A motor drives the pump and the fluid is recycled up through return flow lines 43 and 44.

During the mixture operation, the fluids are pumped downwardly from the fluid tanks into the mixing through the passageways **17*a* and 18*a* which are in direct fluid communication with the return flow lines 43 and 44, respectively. For a better understanding of the details of operation of the fluid flow control and mixing stage 16**, reference is made to the aforementioned Witt et al. U.S. Pat. No. 3,237,808.

The thoroughly mixed beverage is delivered through the pump 22, line 31 and flow mix discharge valve 32 into the carbo-cooler container 30 where the beverage is brought to a final, stabilized carbonated condition with the aid of the pre-carbonating device 33. The carbonated beverage is then delivered to the filler apparatus 25 as mentioned above.

When the production run of a particular flavor beverage is completed, the apparatus is shut down by closing off the water inlet valve 37 and the water flow control valve 21 and syrup flow control valve 20. The system is then cleaned by supplying a quantity of hot water through line **14*b* and the check valve 14 through a flow mix spray valve 46 and into the valve distribution member 23 to be supplied to spray discharge nozzles 47, 48 and 49 within the water receiving chamber, syrup receiving chamber, and mixing chamber, respectively. Also during the cleaning operation, a quantity of cleaning chemical, such as detergent or the like, is introduced into the cleaning fluid by means of a chemical storage tank 50 which is supplied with air pressure by means of an air flow control mechanism 51 to inject the chemical into the cleaning fluid. The cleaning fluid from the mixing chamber 19 is delivered to a plurality of spray discharge nozzles 53 within the carbo-cooler container 30 for cleaning the same. The fluid then is removed from the bottom of the carbo-cooler 30 and delivered to the filler apparatus 25 over the line 54. The cleaning fluid in the embodiment disclosed in FIG. 1 is recirculated through the line 27 and heated by the heater 28 before it is again delivered to the spray nozzles 47 and 48 of the water and syrup flow control chambers 17 and 18. The check valve 41 prevents the cleaning fluid from flowing in a reverse direction through the bottom of the vac-U-cooler 11. In this embodiment the cleaning fluid may be delivered to the syrup selector room to clean the syrup delivery lines by means of a cleaning fluid delivery line 56**. The means for interconnecting the cleaning fluid with the syrup delivery lines will be described in greater detail hereinbelow.

Figure 2:
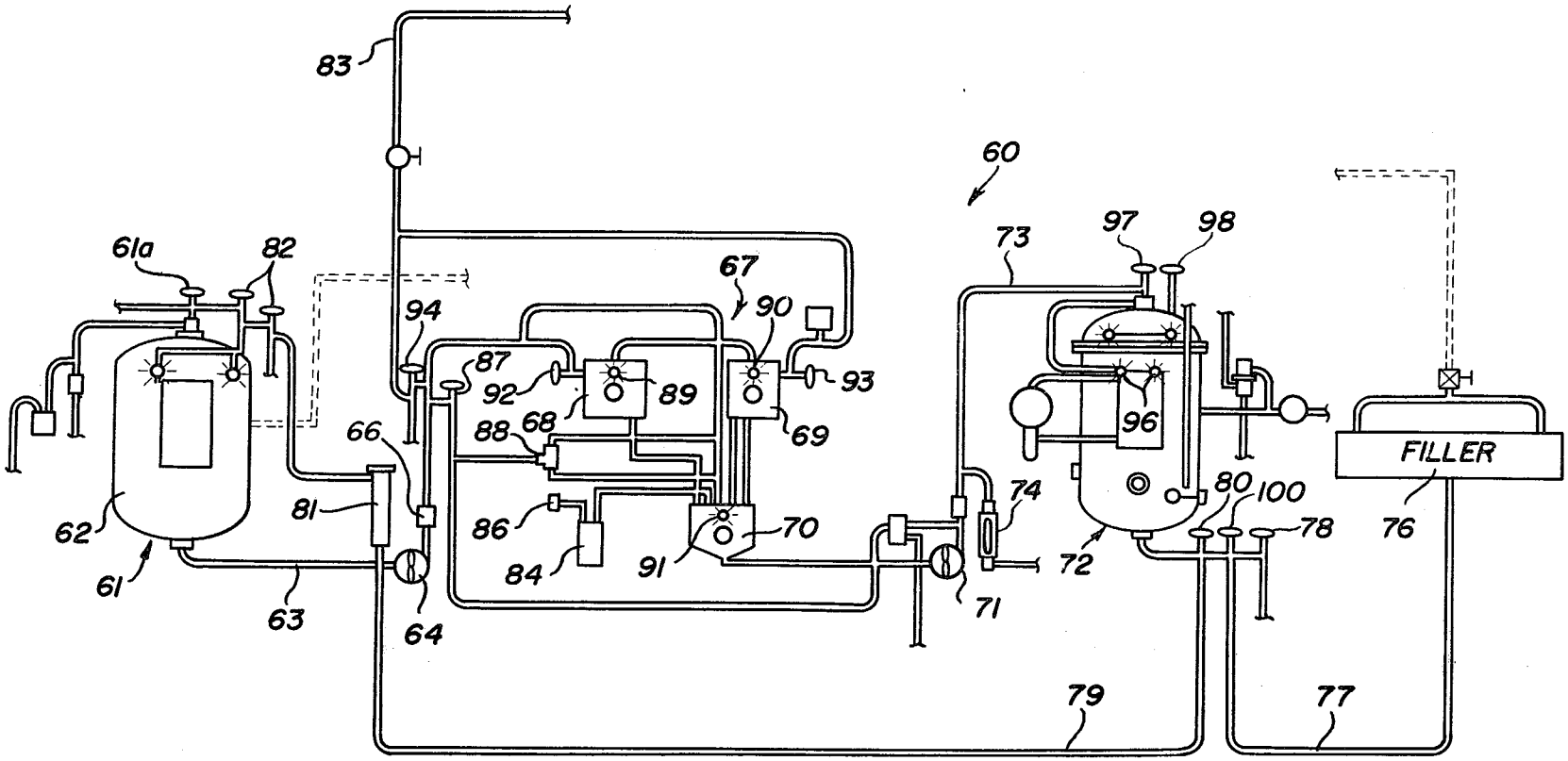
FIG. 2 is an alternate embodiment of the apparatus illustrated in FIG. 1.

Referring now to FIG. 2, there is seen an alternate embodiment of the beverage producing apparatus constructed in accordance with the principles of this invention. Here the apparatus is designated generally by reference numeral 60 and includes a water inlet control valve 61 located at the top position of a deaerator or vac-U-cooler 62 similar to the deaerator 11 described previously. The entering water is degassified in the vac-U-cooler 62 in accordance with well-known technology and this degassified water is then delivered through a supply line 63 to a centrifugal pump 64 in fluid communication therewith. The output of the pump 64 is delivered to a check valve 66 which, in turn, is connected to the input of the flow mix control apparatus designated generally by reference numeral 67. The flow mix control apparatus 67 includes a water receiving chamber 68 and a syrup chamber 69, both of which are in direct fluid communication with a flow mix reservoir 70. The output of the flow mix reservoir is the desired flavored beverage, without carbonation, which is then delivered to a pump 71 which, in turn, drives the flavored beverage into a carbo-cooler container 72 through a line 73. Also associated with the flavored beverage at this point in the system is the primary carbonating apparatus 74 which is used to maintain and control the percent of carbonation of the final product at a predetermined level. Therefore, the apparatus 74 acts as a pre-carbonation stage within the system. Thereafter, the pre-carbonated product is delivered to the carbonator-cooler 72 where final carbonation is obtained. The carbonated beverage from the carbo-cooler is then delivered to a filler structure 76 through a flow line 77.

In a system of the type disclosed in FIG. 2, a clean-in-place operation has previously involved flushing through a solution, either hot or cold water, including a detergent, if desired, and dispensing the cleaning fluid at the output of the carbo-cooler 72 at a drain valve 78. Therefore, considerable amounts of water and detergent were utilized to clean the system, which operation was expensive and wasteful.

In accordance with the present invention, a recirculating return line 79 is connected between the output of the carbo-cooler 72 through a valve 80 and the input of the deaerator 61 through a heating element 81 and a valve control combination 82.

In operation, the system illustrated by the apparatus 60 is shut down and the syrup inlet 83 is disconnected and the various $CO_2$ supply valves shut off and the filling operation shut down. The first step is to charge the entire system with water either via the inlet valve 61*a* or through a bypass valve upstream of the deaerator directly into the flow control chambers 68 and 69. Once the system is fully charged with a supply of cleaning water, the water supply is shut off. A quantity of chemical cleaning compound, either powder, paste or liquid, is supplied to a tank 84 and is introduced into the cleaning fluid as the result of pressure applied thereto from a pressure fitting 86. This may be either an air or a water supply to transfer the cleaning compound into the circulating cleaning fluid. In the illustrated embodiment the chemical material is delivered to the mixing chamber 70, it being understood that the chemical cleaning material can be added to any one of the plurality of different fluid receiving chambers in the system.

The next step is to energize the various pumping arrangements which will cause the water to pass from the deaerator 61 into the line 63 and the pump 64 en route to the flow control chamber 68. This takes place by directing the cleaning fluid through a valve 87 and a directional flow control device 88 to be delivered to the spray nozzles 89, 90 and 91 within the mixing apparatus. At this point in the operation, the inlet valves 92, 93 and 94 are in the closed position. The flow control separator 88 also delivers water to the flow mix reservoir 70 in the same manner as it delivers the beverage forming water. Therefore, cleaning fluid passes through all the lines through which flavored beverages pass.

From the output of the mixer 70 and the cleaning fluid passes through the pump 71 and through the line 73 into the carbo-cooler 72 to be dispersed therein through a plurality of discharge nozzles 96. The valve 97, located at the inlet of the carbo-cooler, is in the closed position during this cleaning operation thereby allowing the cleaning solution to bypass the valve and be delivered to the various spray discharge nozzles within the container. A valve arrangement 98 located at the top of the carbo-cooler is provided with a pair of fluid lines to be delivered to the various discharge spray nozzles.

The cleaning solution then collects at the bottom of the carbo-cooler and passes therefrom into the valve arrangements 78 and 80 and a third valve 100. The valve 78 is connected to a drain discharge line so that the system can be completely drained at the end of the cleaning cycle. The draining operation can take place either from fluid flow from the filler device 76 or from the carbo-cooler 72, or from both, depending on the position of the valves 80 and 100. During the recycling of the cleaning fluid, the fluid is directed through the heater 81, which is preferably of the calrod immersion type, to bring the fluid up to a sterilization temperature very rapidly. The heated cleaning fluid in this instance is delivered back to the inlet of the deaerator 62 rather than to the inlet of the flow control chambers 17 and 18 shown in FIG. 2. Also in this instance, it is a simple matter to select which portion of the cleaning fluid will be recycled, i.e. that portion from the carbo-cooler 72 or that portion from the filler apparatus 76, or both.

During the cleaning operation, valve 61*a* is in the closed condition while valves 82 are in the open condition to allow passage of the cleaning fluid. Therefore, during the cleaning operation valve 62*a* will constitute an inlet to the deaerator and the cycle is continued with the cleaning solution alternately travelling from the deaerator 62 to the flow mix chamber 70 to the carbo-cooler 72 and then back through the heater 81 and again into the deaerator. If desired, the filler member 76 can be connected into the hot recirculating circuit by opening the valve 100. One of the difficulties encountered in sanitizing the filler structure 76 is that with a once through operation of the cleaning fluid, the filler structure is not always brought up to proper sanitizing temperature. Furthermore, in a once through operation of the cleaning fluid, not all of the parts within the filler structure are reached with the cleaning solution. Therefore, it is sometimes desirable to recycle the cleaning solution through the filler apparatus.

Figure 4:
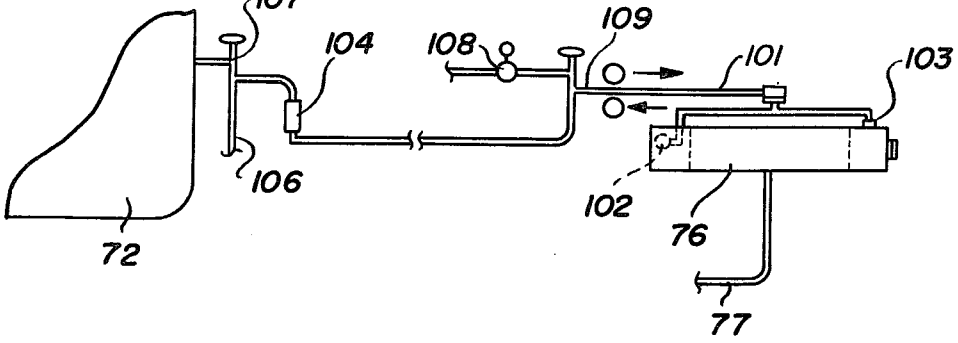
FIG. 4 is a fragmentary showing of a portion of the embodiments of FIGS. 1, 2 and 3.

Referring now to FIG. 4, there is seen a fragmentary portion of the beverage processing apparatus of FIG. 2. During normal filling operation of the apparatus, a counter pressure gas of $CO_2$ is applied to the filler 76 through a line 101 and is controlled by means of a float device 102 located within the filler 76. During the cleaning operation, cleaning fluid within the filler 76 leaves the container thereof through a check valve 103 and is delivered back through the line 101 and through a flow meter 104. At this point, the cleaning fluid can be discharged through a drain 106 or be recirculated into the deaerator 62 through the flow control valve apparatus 107.

During the bottling or canning operation of the carbonated beverage, the beverage is delivered to the filler 76 through the line 77 for injection into the various receptacles. In the filler reservoir, it is desirable to maintain a $CO_2$ atmosphere above the carbonated product. To maintain the proper pressure of the $CO_2$ above the product, a regulator control apparatus 108 is utilized in the line. The flow control direction valve 109 provides means for allowing the $CO_2$ gas to flow in one direction through the line 101 during one instance and allow the cleaning fluid to flow in the other direction through the line during another instance.

Figure 3:
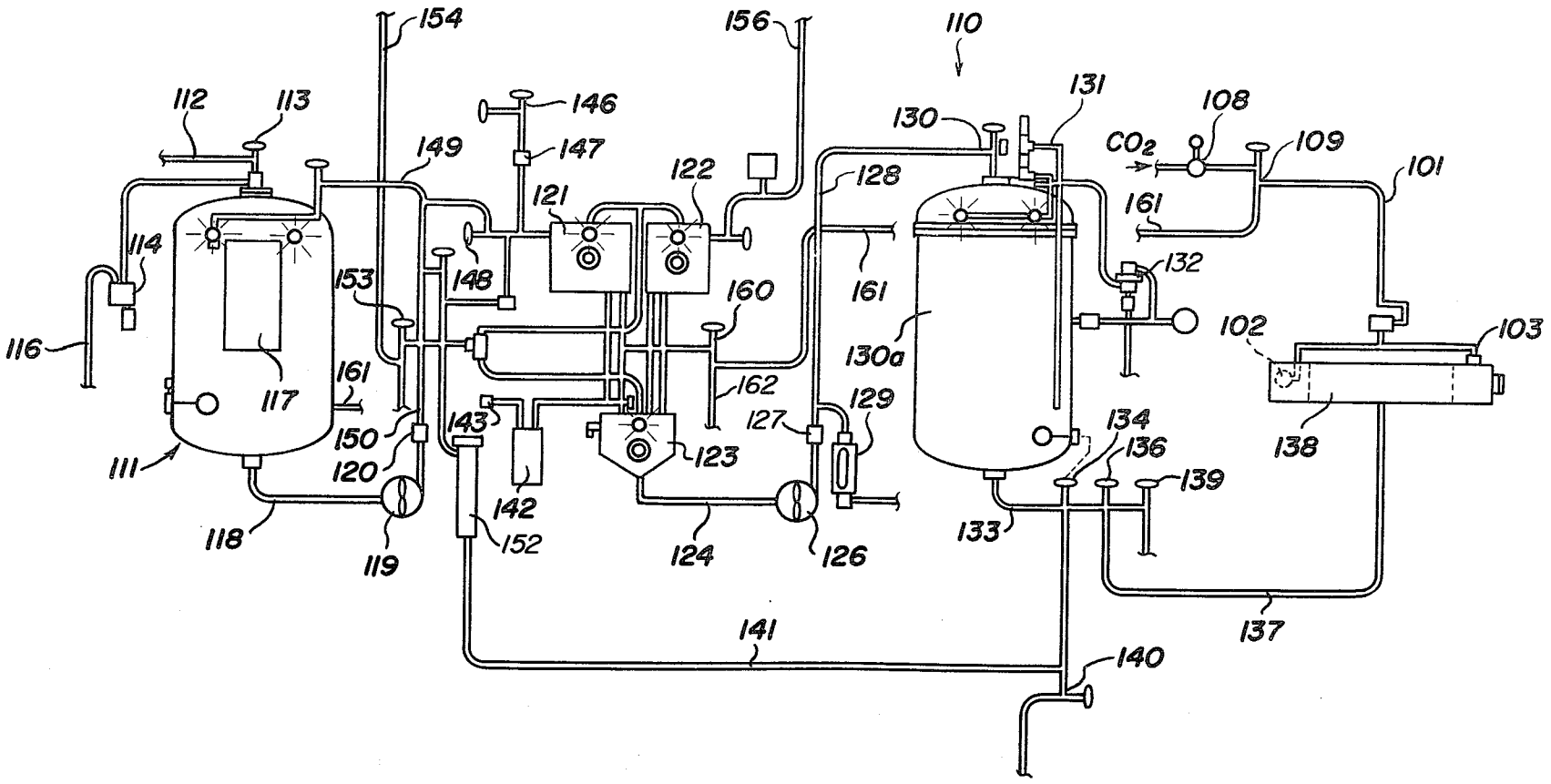
FIG. 3 is still another alternate embodiment of the apparatus illustrated in FIG. 1.

Referring now to FIG. 3, there is seen still another alternate embodiment of apparatus used for mixing various kinds and quantities of fluid to produce an admixture of a carbonated beverage as set forth hereinabove. Here the apparatus is designated generally by reference numeral 110 and includes a first container means 111 which is a deaerator as mentioned above. The deaerator 111 has an inlet line 112 connected to a control valve 113 which supplies water to the deaerator. Also connected to the top portion of the deaerator is a vacuum control regulator 114 which, in turn, has an output line 116 thereof connected to a suitable source of vacuum. As the water passes through the deaerator over various members therein designated generally by reference numeral 117, the water is degassified to eliminate entrapped oxygen and the like before it is delivered through an output line 118 by means of an impeller pump 119 through a check valve 120 to the input of the water reservoir 121. As mentioned above, also associated with the water reservoir is a syrup mixing reservoir 122 and these reservoirs deliver water and syrup to a mixing chamber 123 in the desired proportions to produce the appropriate flavored beverage. The admixture of flavored beverage is delivered through a line 124 and a pump 126 through a check valve 127 into a delivery line 128. Associated with the delivery line 128 is a precarbonating device 129 which is used to regulate the percent of carbonation within the carbonated beverage at the final stages thereof before bottling or canning. The pre-carbonated flavored beverage is delivered to the carbo-cooler 130*a* through a flow control valve structure 130 located at the top of the carbo-cooler which, in turn, also receives $CO_2$ gas through a line 131 for mixing therewith. The gas pressure of the $CO_2$ is controlled by a regulator 132. The carbonated beverage at the output line 133 of the carbo-cooler is then delivered through the valves 134 and 136 into the line 137 and to the filler apparatus 138. A third valve 139 is also connected in fluid communication with valves 134 and 136 to provide means for draining the system.

In this embodiment, a drain and leak detector valve 140 is connected to the return line 141 which is to be used during the recycling of the cleaning fluid. The gas pressure head control and the cleaning fluid return lines associated with the filler 138 are substantially the same as that shown in FIG. 4 and the corresponding similar components are designated with corresponding similar reference numerals.

In the embodiment of FIG. 3, the deaerator 111 is not connected in fluid communication with the rest of the system during the cleaning operation as it is sometimes not necessary to clean the deaerator because only water passes therethrough. The chemical reservoir of cleaning material 142 is connected to the mixing chamber 123 and has air pressure control means 143 associated therewith. Energization of suitable air switch devices (not shown) will pressurize the container 142 and urge the cleaning chemical into the mixing chamber 123. In this embodiment, during the cleaning operation, hot water is charged into the system through a hot water control valve 146 and a check valve 147 connected in fluid communication therewith. The hot water is first directed into the water receiving reservoir 121 and a flow control valve 148 is closed so as to prevent backup of the cleaning fluid into the lines 149 and 150. The hot water fills the reservoir 121 and flows down into the mixing chamber 123 where it receives the cleaning chemical. The cleaning fluid then is delivered through the pump 126, check valve 127 and line 128 to the top of the carbo-cooler 130*a*.

The cleaning fluid then passes through the carbo-cooler into the lower exit line 133 through the pair of valves 134 and 136 and into the filler apparatus 138 via the line 137. It will also be noted that the cleaning fluid, either partially or entirely, may be diverted back through the system through the line 141 and through a heater 152 where the fluid is heated to a sterilization temperature before it is delivered back into the water reservoir 121. A valve arrangement 153 enables the heated water to be delivered through a line 154 into the syrup supply room where the appropriate connections are made to flush out the syrup delivery line 156 connected to the syrup reservoir 122. The syrup reservoir at this time receives cleaning fluid so that it is properly cleaned and sterilized by the heated cleaning fluid which, in turn, is again delivered to the mixing chamber 123. The manner in which the syrup feed line is connected in fluid communication with the cleaning fluid will be discussed in greater detail hereinbelow. The return cleaning fluid from the filler 138 is delivered through the line 101, valve arrangement 109 and a line 161, here illustrated as a broken line, into a valve arrangement 160 where it can either go to a drain outlet 162 or be delivered to the downspout portion of the reservoir 121 to be applied to the mixing chamber 123.

Figure 5:
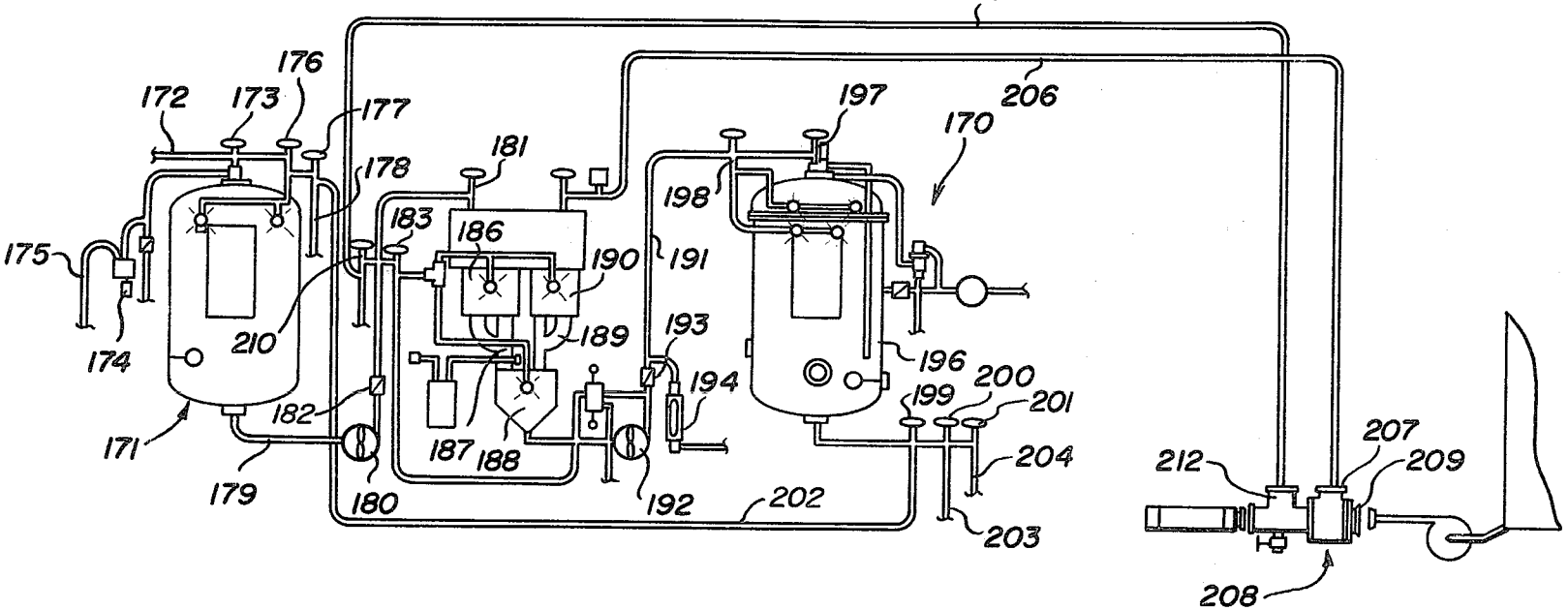
FIG. 5 illustrates apparatus for mixing various kinds of fluids wherein the syrup supply lines are automatically cleaned by operation of valve means.

Referring now to FIG. 5, there is seen a more detailed showing of the manner in which the syrup feed lines are connected in fluid communication with the cleaning fluid. Here the system is designated generally by reference numeral 170 and includes a deaerator 171 which has an inlet line 172 connected to the top valve 173 for receiving a quantity of water to be degassified in the usual manner. Degassification takes place as the result of a vacuum control apparatus 174 which has an output line 175 thereof connected to a suitable source of vacuum. Also located at the top of the deaerator 171 is a valve 176 which is used to control the flow of cleaning fluid during the cleaning operation. A second valve 177 controls the circulating fluid and, when operated, delivers the cleaning fluid to a suitable drain line 178. With the valve 177 in the other position, the cleaning fluid will be recirculated into the deaerator. The output of the deaerator is delivered through a line 179 into a pump 180 which, in turn, is connected to the flow mix water control valve 181 through a check valve 182 and through a valve arrangement 183 for selectively controlling the passage of beverage making water or cleaning fluid. The water reservoir 186 has the output line 187 thereof connected to a mixing chamber 188 which, in turn, is also connected to an output line 189 of a syrup receiving reservoir 190. The flavored beverage is then pumped through a line 191 by means of a pump 192, through a check valve 193 whereat initial pre-carbonation is achieved by the use of a carbotrol apparatus 194. The pre-carbonated fluid is delivered to the carbo-cooler 196 via a valve arrangement 197 located at the top thereof, which carbonated fluid also passes through a valve 198 used selectively to deliver cleaning fluid to the carbo-cooler. The output of the carbo-cooler is delivered to a plurality of valves 199, 200 and 201 connected to a recirculating line 202, a filler line 203, and a drain line 204, respectively.

In the embodiment disclosed herein, the syrup is delivered to the syrup reservoir 190 through a line 206 which, in turn, is connected to an output port 207 of a syrup flow control valve 208. The flavored syrup is delivered to an inlet port 209 of the valve 208 during the beverage forming operation.

During the cleaning operation, cleaning fluid is delivered through the valve 183 and the valve 210 through a line 211 to a second inlet port 212 of the valve 208. Actuation of the valve will close the inlet port 209 and provide communication between the port 212 in the outlet port 207 so that cleaning fluid can be cycled through the valve and through the line 206 to the inlet of the syrup reservoir.

Figure 6:
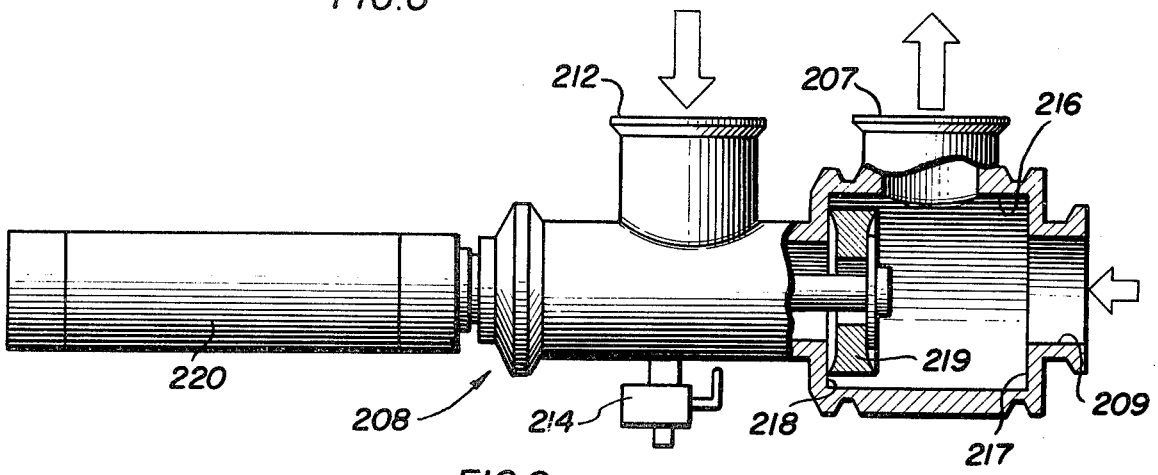
FIG. 6 is an enlarged partially sectional view of a valve structure utilized in the apparatus of FIG. 5.

Referring now to FIG. 6, a detailed showing of a new and improved syrup flow control valve is made. Here the syrup flow control valve 208 is shown having a manually operated bleed valve 214 connected in fluid communication with the cleaning fluid inlet port 212. The internal chamber 216 of the valve is provided with diametrically opposed spaced apart valve seat portions 217 and 218 against which seats a movable valve stopper 219. In the position shown in FIG. 6, the valve stopper 219 seals the inlet port 212 from the outlet port 207 so that only flavored syrup passes through the valve from port 209 to port 207. Upon actuation of a suitable actuating device 220, such as a solenoid or air cylinder, the disc-shaped movable stopper 219 is urged against the valve seat 217 to place the inlet port 212 in fluid communication with the outlet port 207, thereby allowing passage of the cleaning fluid therethrough. This then allows the cleaning fluid to be delivered through the syrup line 206, FIG. 5, and into the syrup reservoir 190. This valve structure allows in-place cleaning of the syrup delivery lines without the need of opening the line to isolate the syrup delivery system.

Figure 7:
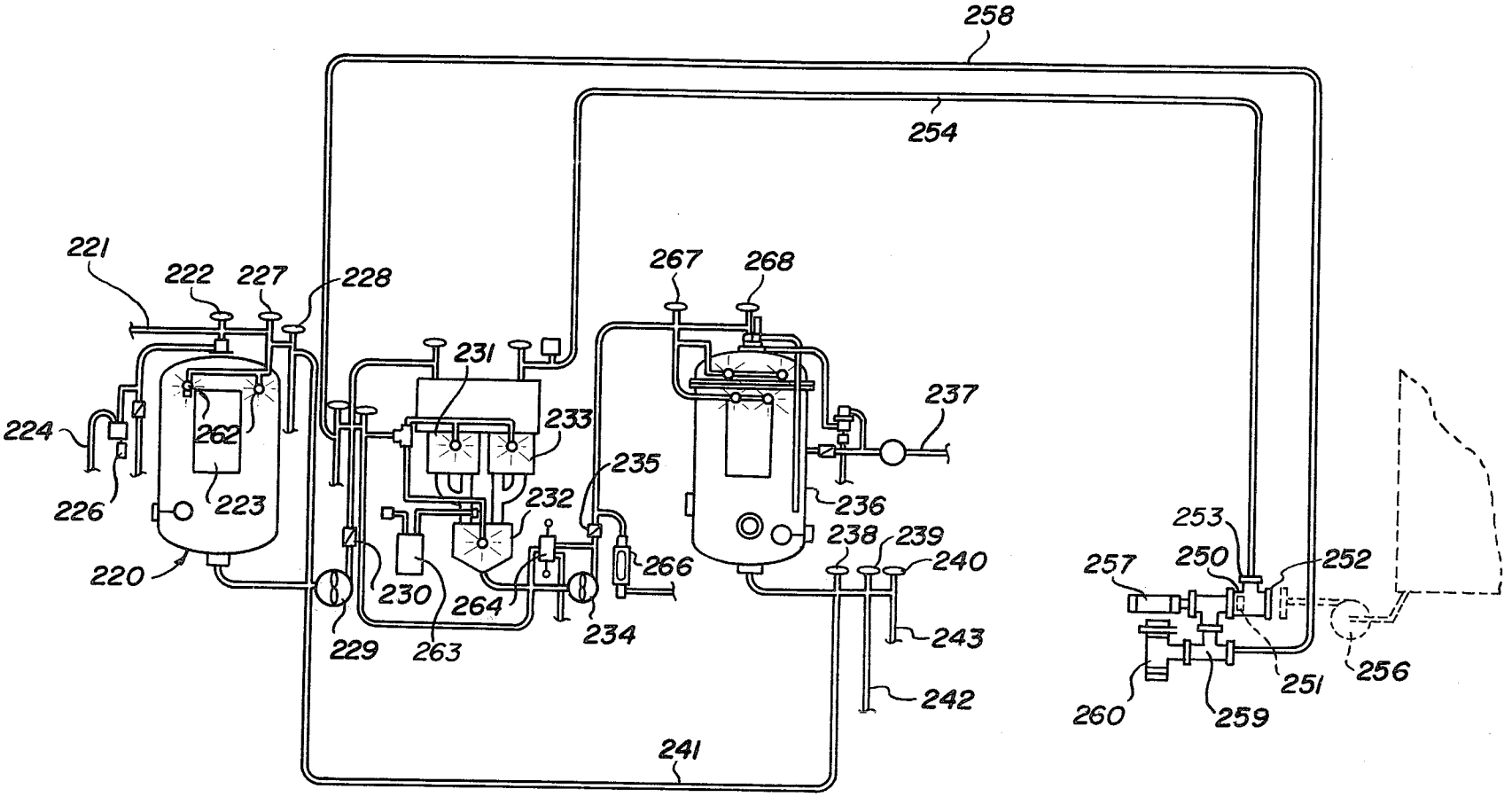
FIG. 7 is an alternate embodiment of the apparatus of FIG. 5.

Referring now to FIG. 7, there is seen still another alternate embodiment of the present invention. Here a deaerator 220 is supplied with filler water through a line 221 and a fluid flow control valve 222 so that the water passes over a plurality of degassifying plates designated generally by reference numeral 223. A vacuum is supplied to the interior of the deaerator through a line 224 and a vacuum moisture trap 226 is utilized to prevent moisture from being drawn into the vacuum system. Also associated at the top of the deaerator 220 is a fluid flow control valve 227 and a drain flow control valve 228. The output of the deaerator is delivered to a pump 229 which, in turn, delivers the water through a check valve 230 into a water receiving reservoir structure 231. The water is then delivered to a mixing chamber 232 simultaneously with a quantity of syrup delivered thereto from a syrup reservoir 233. The flavored beverage is then delivered via a pump 234 through a check valve 235 into the top of the carbo-cooler 236. A quantity of $CO_2$ is also delivered to the carbo-cooler through a line 237 thereby carbonating the beverage to a desired percentage level. The carbonated beverage is then delivered to a plurality of control valves 238, 239 and 240 for providing recirculating cleaning fluid through a line 241, delivering carbonated beverage to the filler through a line 242, and for connection to a drain outlet line 243, respectively.

During the beverage forming operation, flavored syrup is delivered to a valve 250 having a movable flow control actuator 251 located therein. During the syrup flow condition, an inlet port 252 is in fluid communication with an outlet port 253. The syrup is forced through the valve 250 and a line 254 by means of a pump 256. Actuation of the actuator 257, by means of air pressure in the case of an air cylinder, will cause the movable valve member 251 to close off the inlet port 252. The cleaning fluid is then delivered through a line 258 through a pipe tee 259 and back through the outlet port 253 so that cleaning fluid is delivered to the syrup reservoir 233. Also connected to the tee 259 is a drain outlet control 260 which can be selectively actuated as desired.

In this instance the return recirculating line 241 is connected to the valve arrangement 227 and 228 wherein the deaerator 220 can be cleaned if desired by closing off the valve 228 with regard to the drain line thereof and allowing the cleaning fluid to pass through the valve and through the valve 227 to the pair of spray discharge nozzles 262 located within the deaerator 220.

Here again, a chemical material is provided in a container 263 which is connected to the mixing chamber 232 selectively to deliver thereto a quantity of chemical cleaning material, either liquid or powder or the like. In the embodiment illustrated in FIG. 7, a flow mix manual spray valve 264 is provided to bypass the pump 234 and may be used to interject additional water into the flavored beverage just upstream of the carbotrol device 266, or it may be used to deliver cleaning fluid thereto if desired. The pair of valves 267 and 268 located on top of the carbo-cooler 236 are used to control the flow of pre-carbonated fluid and cleaning fluid during the respective production and cleaning operations.

Figure 8:
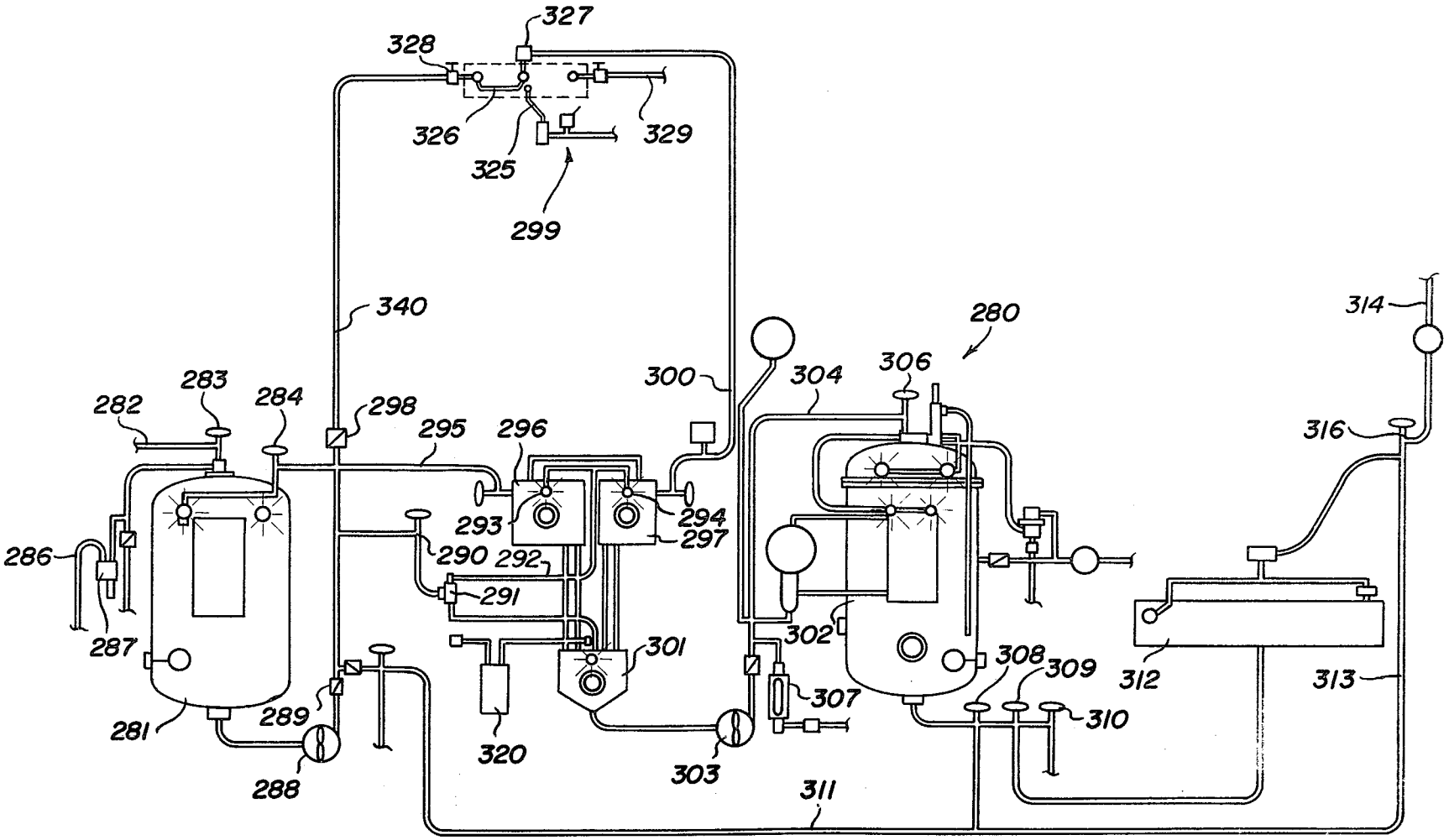
FIG. 8 illustrates still another alternate embodiment of the present invention.

Referring now to FIG. 8, there is seen still another alternate embodiment of the apparatus constructed in accordance with the principles of this invention, and designated generally by reference numeral 280. Here the apparatus 280 has a deaerator 281 connected to a supply of water through an inlet line 282 and a fluid flow control valve 283. Also connected to the top of the deaerator is a cleaning fluid supply line and valve 284. Vacuum is delivered to the deaerator 281 through a vacuum line 286 which, in turn, has connected thereto a moisture trap device 287. The output of the deaerator 281 is delivered through a pump 288, a check valve 289 and through a valve 290, distribution member 291 and a line 292 to a pair of spray discharge nozzles 293 and 294 associated with the interior of the water reservoir 296 and the syrup reservoir 297, respectively. During the beverage making operation, the degassified water is delivered to the water reservoir 296 through a line 295. Water does not pass through a check valve 298 into the syrup supply room, here designated generally by reference numeral 299.

Syrup is delivered from the syrup room 299 through a line 300 into the syrup reservoir 297 which, in turn, delivers the syrup in a controlled manner to a mixing container 301. The flavored beverage is then delivered to a carbo-cooler 302 via a pump 303, line 304 and fluid flow control valve 306. Once again, the beverage is pre-carbonated by means of a precarbonating device 307. The output of the carbo-cooler 302 is delivered to a plurality of fluid control valves 308, 309 and 310. The valve 308 is connected to the fluid recirculating line 311 which, in this instance, is also connected in fluid communication with the output of the filler apparatus 312 via a line 313. The fluid flow control valve 309 is connected to the input of the filler apparatus 312 for delivering thereto a quantity of cleaning fluid. Valve 310 is connected to a suitable drain. Also connected to the drain is an output line 314 which, in turn, is connected to the output of the filler apparatus 312 via a control valve 316.

A container of chemical cleaning material 320 is connected to the mixing container 301 as mentioned above with regard to the other configurations of this invention. During the cleaning operation, the cleaning fluid is introduced into the system in the syrup room 299 by disconnecting the syrup feed line 300, this being illustrated by reference numeral 325, which illustrates a disconnection of the syrup feed line. A jumper line 326 is then connected between an air operated valve 327 and a water flow control valve 328. Hot water is introduced into the system through a hot water supply line 329 to charge the various containers of the system with a cleaning fluid. While a heater element is not shown in the recycling line 311, it will be understood that one may be used if desired.

Figure 9:
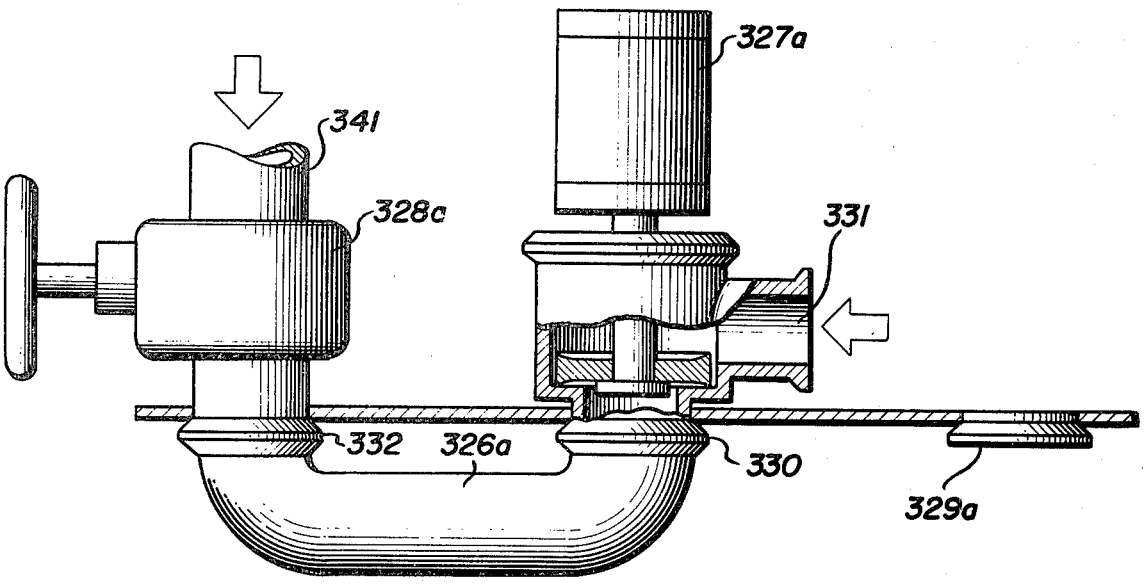
FIG. 9 is a top view of a manually operated valve distribution panel for connection to supply syrup to the beverage making apparatus during one instance and to receive a cleaning fluid during another instance.
Figure 10:
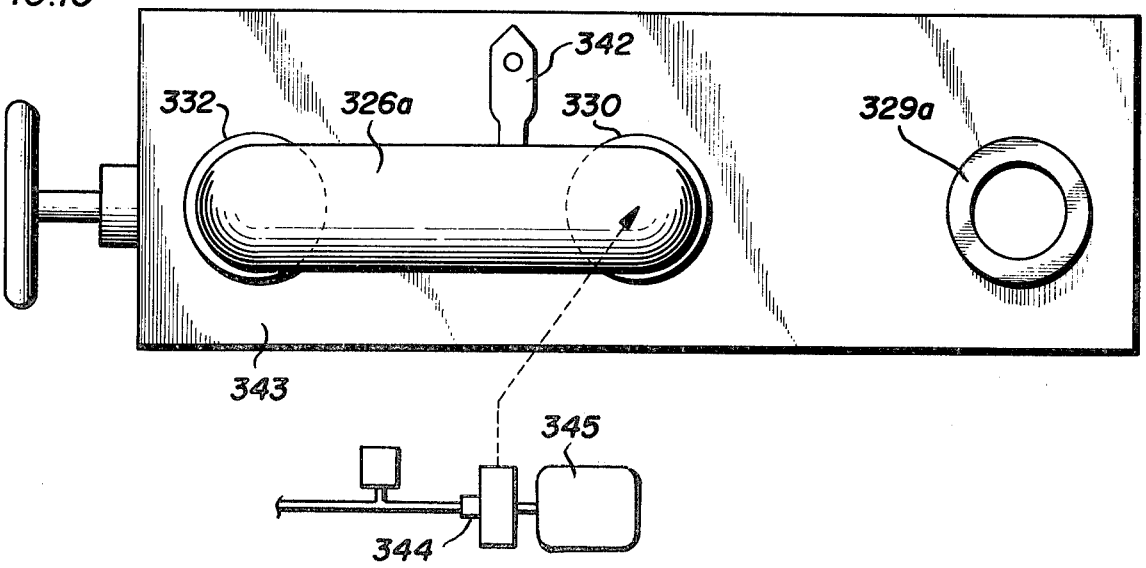
FIG. 10 is a front view of the control valve panel assembly of FIG. 9.

For an understanding of one type of valve configuration that can be used in the syrup room to facilitate charging of the system with cleaning fluid, reference is now made to FIGS. 9 and 10 which illustrate a panel having the various valves associated therewith. During the normal operation of forming carbonated flavored beverage, the syrup is connected to the valve 327*a* at the inlet port 330 so that it flows through the output port 331 through the line 300 and into the syrup reservoir 297. During this time, the water flow control valve 328*a* is closed and the jumper pipe 326*a* is not connected. To perform the cleaning operation, a hot water supply connection 329 (FIG. 8) is connected to the inlet 330 by placing the jumper pipe 326*a* in fluid communication between the outlet 329*a* and the inlet port 330. Once the complete system is charged with a quantity of cleaning water, the jumper pipe 326*a* is then disconnected from the water supply port 329 and connected to the recirculating flow control valve 328 via its associated outlet port 332. The fluid then travels upwardly through the check valve 298 and line 340, FIG. 8, into the inlet portion 341 of the valve 328*a*, the outlet port 332, the jumper pipe 326*a*, and through the inlet and outlet ports of the syrup flow control valve 327*a*.

When the cleaning operation is completed, the jumper pipe 326*a* is disconnected from the inlet port 330 of the syrup flow control valve 327*a* and the syrup tubing is again connected. A selector switch 342 (FIG. 10) is located on a front panel member 343 of the syrup distribution panel and may be used to energize a suitable air actuated fluid flow control valve 344 of a desired syrup container 345. Therefore, after a particular production run of a given flavor of beverage, and after the appropriate cleaning cycle, a different flavored beverage can be manufactured relatively quickly after a previous flavor beverage has been manufactured.

All of the embodiments disclosed hereinabove are also intended to be used with steam as a means of high temperature cleaning fluid. In each instance the hot water inlet will be a steam inlet and the in-place cleaning cycle of operation will be substantially the same.

Figure 11:
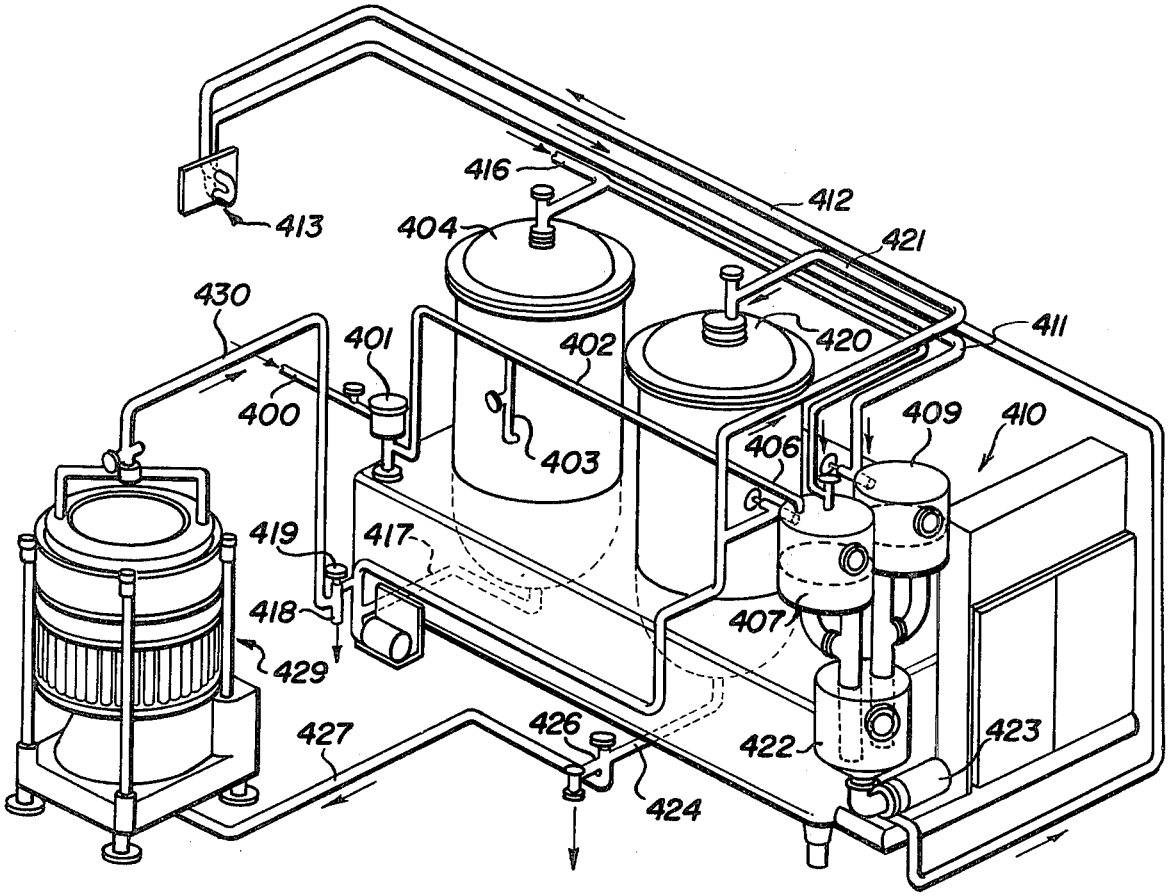
FIG. 11 is a schematic illustration of a hot sanitizing flow pattern which can be obtained by the construction of this invention.

FIG. 11 is a schematic illustration of a flow pattern of hot sanitizing fluid, which in this instance is steam. Here a steam inlet pipe 400 is connected to a purifying device 401 to insure that no particulate matter is delivered to the system. The output of the filter device 401 is connected to a conduit 402 which, in turn, has a branch 403 connected to the vac-u-cooler 404, and a second branch 406 connected to the water supply tank 407 of the mixing stage 410. A syrup supply tank 409 receives cleaning fluid through a line 411 which, in turn, is in fluid communication with a line 412 via a syrup and supply room or panel designated generally by reference numeral 413. However, the fluid passing through the conduits 411 and 412 is hot cleaning fluid which is a combination of steam and make-up water. Make-up water in this instance is delivered to a line 416 into the top of the vac-u-cooler 404 and into the top of the water reservoir 407 of the mixer 410. At this point steam and make-up water are mixed together to provide a hot water fluid to pass through the pipes.

Steam and hot water are also combined in the vac-u-cooler 404 and provide a hot water cleaning fluid to pass through a conduit 417 to a drain outlet 418 when a hand valve 419 is opened.

The carbo-cooler 420 receives cleaning fluid through a conduit 421 which, in turn, is connected to the output of the mixing tank 422 of the mixer 410. This fluid is delivered by means of a pump 423. The cleaning fluid in the carbo-cooler 420 is then delivered through a line 424, T-valve 426, and line 427 to the input of the bottling apparatus 429. This cleaning fluid is then removed from the bottling apparatus 429 by the upper conduit 430 back to the drain 419.

If desired, after all of the cleaning fluid in the system is removed, the entire system again can be purged with steam from line 400. Any of the systems illustrated herein can utilize the combination of steam and water as illustrated in FIG. 11.

What has been described is a simple and efficient apparatus for mixing various kinds of fluids to produce an admixture of a flavored beverage, which apparatus is readily cleaned in place without disconnection of the fluid flow control lines thereof. While several specific embodiments of the invention have been illustrated in great particularity herein, it will be understood that variations and modifications of this invention may be effected without departing from the spirit and scope of the novel concepts disclosed and claimed herein.

The invention is claimed as follows:

1. System for cleaning a beverage apparatus comprising a source of a first fluid flow, fluid degasifying means for receiving the first fluid flow from its source and degasifying the flowing first fluid, a source of a second fluid flow, proportioner means for receiving the flowing degasified first fluid from the degasifying means, for receiving the flowing second fluid from the second fluid flow source, and for mixing the degasified first fluid flow and the second fluid flow to form a beverage flow during a filling operation, a source of a beverage carbonating gas flow, beverage carbonating means for receiving the beverage flow from the proportioner means, for receiving the carbonating gas flow, and for mixing the carbonating gas flow and the beverage flow during the filling operation, filler means for receiving the flow of carbonated beverage and for directing discrete quantities of the carbonated beverage to discrete receptacles during the filling operation, a source of cleaning fluid flow, cleaning fluid injector means for introducing the cleaning fluid flow into the proportioner means during a cleaning operation, a source of a cleaner, cleaner injector means for injecting the cleaner into the proportioner means during the cleaning operation, means for routing the first fluid, the second fluid, and the beverage through the proportioner means, the carbonating means and into the filler means during the filling operation, and for routing the cleaning fluid and cleaner sequentially through the proportioner means, the carbonating means and the filler means during the cleaning operation, recirculating line means for recirculating the cleaning fluid and cleaner from the filler means to the proportioner means, heater means in the recirculating line means for heating the recirculating cleaning fluid and cleaner, drain means for draining the cleaning fluid and cleaner from the beverage apparatus, coupling panel means, and selective coupling means mounted on the coupling panel means for selectively connecting the second fluid flow source to the proportioner means to deliver the second fluid flow to the proportioner means during the filling operation, and alternatively connecting the recirculating line means to the proportioner means for endlessly recirculating the cleaning fluid and cleaner through the beverage apparatus during the cleaning operation.

2. System according to claim 1 including precarbonator means interposed between said proportioner means and said beverage carbonating means, said drain means being interposed between said precarbonator means and said beverage carbonating means for exhaustively draining the cleaning fluid in the cleaner from the beverage apparatus.

3. The system for mixing flavored beverages as set forth in claim 1 wherein said heating means is an electric heater to raise the temperature of the recirculating cleaning fluid sufficiently to sterilize said syrup supply distribution panel and said mixing container means and said carbonating means.

4. The system as set forth in claim 3 further including supply tank means in fluid communication with said proportioner means, and adapted to receive a quantity of chemical cleaning material therein to be added to the cleaning fluid during the cleaning cycle of operation of the apparatus.

5. The system as set forth in claim 4 further including air supply connection means coupled to said supply tank means to be selectively energized to force said chemical cleaning material from said supply tank means into said proportioner means.

* * * * *